US006082572A

United States Patent [19]

Galton-Fenzi et al.

[11] Patent Number: 6,082,572

[45] Date of Patent: Jul. 4, 2000

[54] SECURITY CONTAINER WITH LOCKING LID

[75] Inventors: Miles Douglas Montague Galton-Fenzi, Cambridge; Malcolm Brown, Peterborough, both of United Kingdom

[73] Assignee: BGF Health Care Products Ltd., Cambridge, United Kingdom

[21] Appl. No.: 09/117,467

[22] PCT Filed: Jan. 31, 1997

[86] PCT No.: PCT/GB97/00305

§ 371 Date: Aug. 7, 1998

§ 102(e) Date: Aug. 7, 1998

[87] PCT Pub. No.: WO97/28058

PCT Pub. Date: Aug. 7, 1997

[30] Foreign Application Priority Data

Jan. 31, 1996 [GB] United Kingdom ..... 9601960

[51] Int. Cl.[7] ..... B65D 45/00

[52] U.S. Cl. ..... 220/315; 70/63; 70/312; 206/1.5; 215/206; 215/237; 220/836

[58] Field of Search ..... 206/1.5; 220/315, 220/326, 210, 836; 70/63, 30, 312; 215/206, 237

[56] References Cited

U.S. PATENT DOCUMENTS

| | | | |
|---|---|---|---|
| 3,082,865 | 3/1963 | Nemsky | 206/1.5 X |
| 3,421,347 | 1/1969 | Sotory | 70/63 |
| 3,610,475 | 10/1971 | Gach | 220/315 X |
| 3,782,577 | 1/1974 | Levey . | |
| 3,901,407 | 8/1975 | Mitchell et al. . | |
| 3,930,388 | 1/1976 | Barras | 220/210 X |
| 3,988,909 | 11/1976 | Catapano | 70/63 |
| 4,343,163 | 8/1982 | Scelba et al. | 70/312 |
| 4,535,903 | 8/1985 | Franchi . | |
| 4,561,544 | 12/1985 | Reeve | 206/1.5 X |
| 4,730,731 | 3/1988 | Allison | 206/1.5 X |
| 5,517,836 | 5/1996 | Hong | 70/30 |
| 5,918,758 | 7/1999 | Galton-Fenzi | 220/315 |

FOREIGN PATENT DOCUMENTS

WO 95/26307 10/1995 WIPO .

*Primary Examiner*—Bryon P. Gehman
*Attorney, Agent, or Firm*—Baker & Daniels

[57] ABSTRACT

A container requiring more than one operation to open is provided. The container includes a hollow body and a lid attached to the hollow body which opens in a given direction. The container also includes a manually-operable member that is biased by a biasing element into a first position at which the member engages the closed lid. The member is moveable against the biasing element into a second position at which the lid is releasable. In the first position, the lid positively engages the member, and is disengageable from the member by first moving the lid in a direction other than the given direction in which the lid opens. The lid is closeable when the member is in the first position.

18 Claims, 8 Drawing Sheets

SECURITY CONTAINER WITH LOCKING LID

BACKGROUND OF THE INVENTION

1. Field of the Invention

This invention relates to containers, and in particular to security containers of the type requiring more than one operation to open them. Such containers include child-resistant containers that hold medicaments.

2. Description of the Related Art

Containers of pharmaceuticals or medicaments in solid dose form, such as tablets, pills or pellets, should be secure. More specifically, they should be child-proof or child-resistant, i.e. they should be difficult or impossible to open, by a simple operation.

One known type of security container has a screw-on lid that must be pressed firmly down before it can be unscrewed. Another type has a lid that must be correctly aligned before it can be prised off. However, a press-down lid may be very difficult for the aged or arthritic to operate, while the most common container requiring alignment (of respective marks on the lid and on the container body) may be too easily opened by an intelligent child.

U.S. Pat. No. 4,535,903 describes a security container in which the lid includes a retractable member. When retracted, there is no evident means of opening the lid; manipulation of the member, through a window in the lid, allows it to be pushed out from the lid, only then providing an evident tab, for opening the lid. Although this device should be easy to operate without it being readily evident how it can be opened, it suffers from several practical disadvantages. These disadvantages include ease of opening, e.g. by a child using teeth, or accidental opening, even when the retractable member is retracted, and the difficulty of balancing ease of retraction/opening, e.g. for the infirm or those with large fingers, with desired security. Further, a bulky lid is required, especially if the retractable member is to be adequately durable, with attendant problems of plastic shrinkage, and difficulty in moulding and manufacture, e.g. non-suitability for ultrasonic welding. This also means that the container must be sufficiently large that it will not generally be considered portable.

U.S. Pat. No. 3,901,407 discloses a locking cap assembly for a filler neck, e.g. of an automobile gasoline tank. The cap is releasable only after a partially-visible shaft is depressed, and this depression is only possible following correct setting of a combination lock. The numerals on the combination lock are visible at all times. The intention is to make opening of the cap impossible for all but the user who knows a pre-set combination.

WO-A-9526307 also discloses a container of the type requiring more than one operation to open. This container comprises a hollow body, a lid for the body, means for realisably engaging the lid such that the body is closed, and a marked member. The marked member is moveable between a first position at which the mark is hidden and said means engages the lid and a second position at which the mark is visible and the lid is releasable. This container is predicated on the non-visibility of marks indicating that there is a means of opening; by contrast, systems utilising a combination lock indicate that such means exist, but may be difficult to use successfully.

BRIEF SUMMARY OF THE INVENTION

According to the present invention, a security container of the general type described in WO-A-526307 relies, not on the use of a marked member but on the provision of means for biasing the member into the first position, and the ability to close the lid when the member is in that position. In this way, the container is self-locking.

As described in more detail in WO-A-9526307, the contents of which are incorporated herein by reference, the manually-operable member is preferably a knurled cylinder, in one or more parts, sitting in a window-like aperture in the side of the container body. It may be rotatable in a plane that is generally parallel to a lid on top of the body.

The lid may be slidable, e.g. within rebated grooves, in which case it will generally engage the upper face of the cylinder. Alternatively, the lid may be hingedly attached to the container, in which case it generally includes a lug that engages an under face of the cylinder. It is particularly preferred that the cylinder should include one or more recesses which the lug engages, in which case depression of the lid may be necessary in order to release the cylinder.

The biasing means may be provided by one or more flexible protrusions formed as part of the container body and/or on the cylinder. Alternatively, the cylinder may be spring-mounted on its axis; the spring may be integral or independent. Other biasing means will be apparent to those of ordinary skill in the art.

BRIEF DESCRIPTION OF THE DRAWINGS

The invention will now be described by way of example only with reference to the accompanying drawings, in which:

FIGS. 7A through 8B show views corresponding respectively to those of FIGS. 2A through 3B, of an alternative embodiment of the invention, and FIGS. 7B and 8B are sectional views taken along lines 7B—7B of FIG. 7A and 8B—8B of FIG. 8A, respectively, viewed in the direction of the arrows;

FIG. 14B is a partial sectional view taken along line 14B—14B of FIG. 14A.

DETAILED DESCRIPTION

Figure 1:
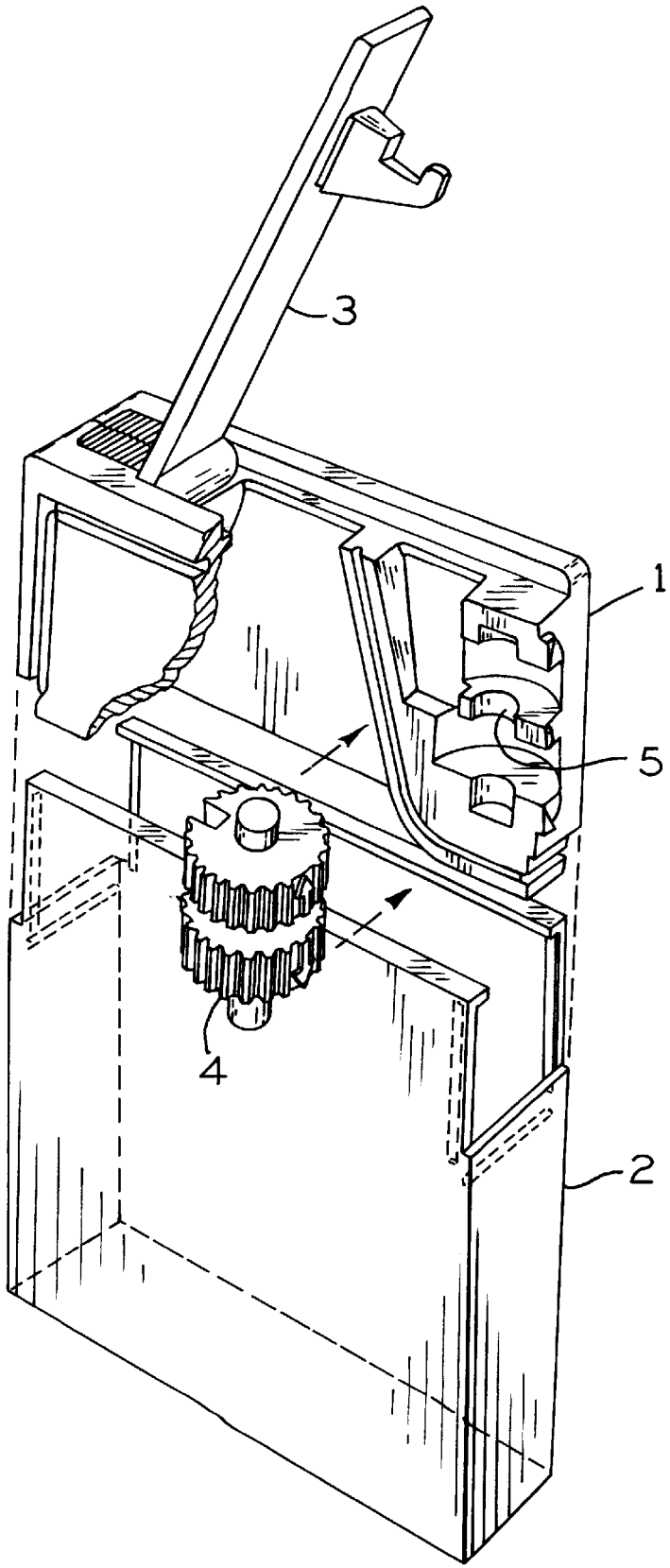
FIG. 1 is an exploded view of a container of the invention.

FIG. 1 shows a security container comprising a top part 1 and a lower part 2, a lid 3 and a cylinder 4 that is rotatable in a corresponding recess seen at 5 in the top part 2. The top part is described in greater detail below.

Figure 2A:
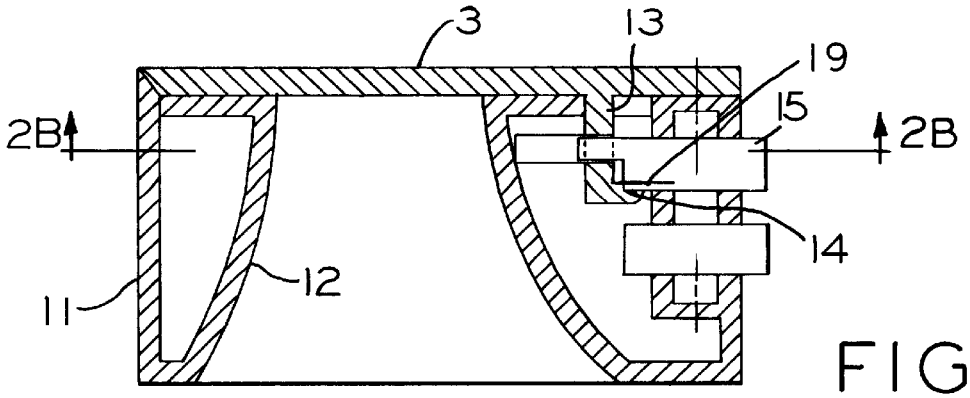
FIG. 2A is a sectional view of the top part of a container embodying the present invention, shown in the locked position.
Figure 2B:
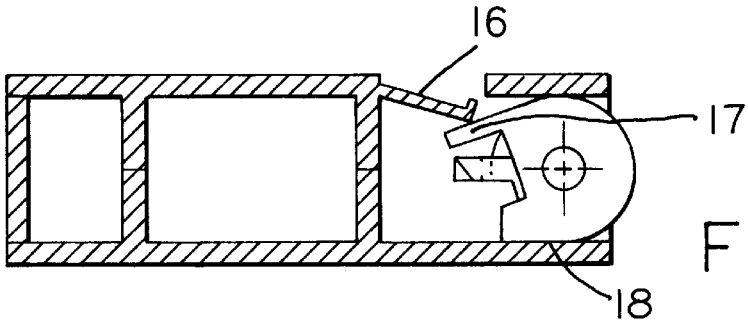
FIG. 2B is a sectional view taken along line 2B—2B of FIG. 2A, viewed in the direction of the arrows.

FIGS. 2A and 2B show the top part only of the security container. This part comprises an external wall 11 and an internal wall 12. The wall 12 is shaped as a funnel, to aid release of the contents. The lid 3 has an integral tongue 13 on which is formed a lug 14. Cylinder 4 includes manually-operable cylindrical member 15 rotatable within a part of the wall of the container. The container is formed with a flexible flexible biasing element 16 which acts against an extension 17 of the cylindrical member, biasing it into the position shown. Movement of the cylindrical member in the opposite direction is prevented by means of the enlarged portion 18. An underface of the cylindrical member is formed with a recess 19 that engages with the lug 14. This (or a downstand, or bumpstop, by way of example) provides an added locking feature.

Figure 3A:
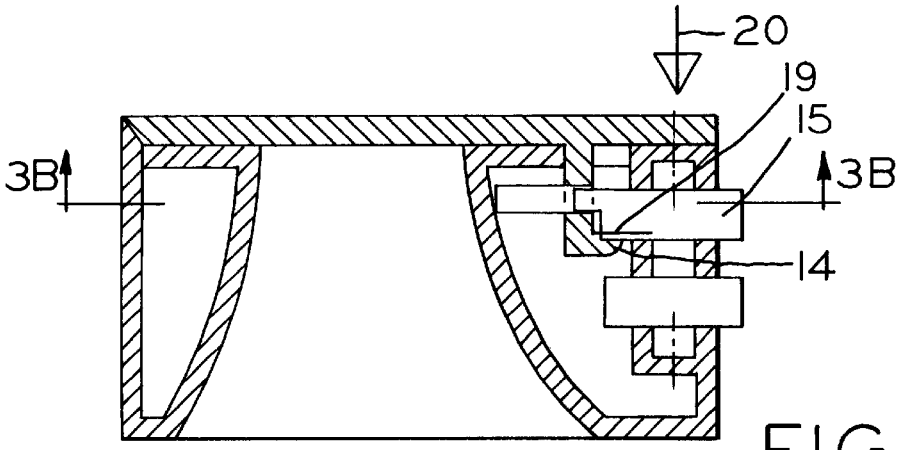
FIG. 3A shows the embodiment of FIGS. 2A and 2B, in the unlocked position.
Figure 3B:
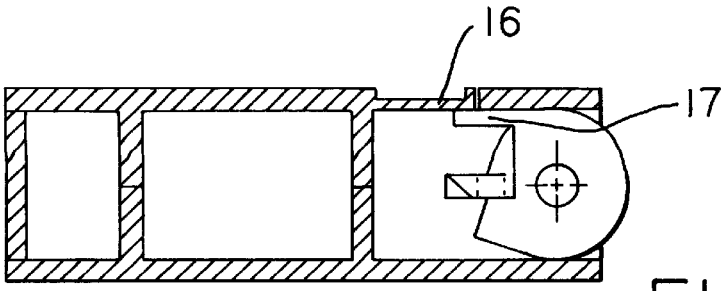
FIG. 3B is a sectional view taken along line 3B—3B of FIG. 3A, viewed in the direction of the arrows.
Figure 4:
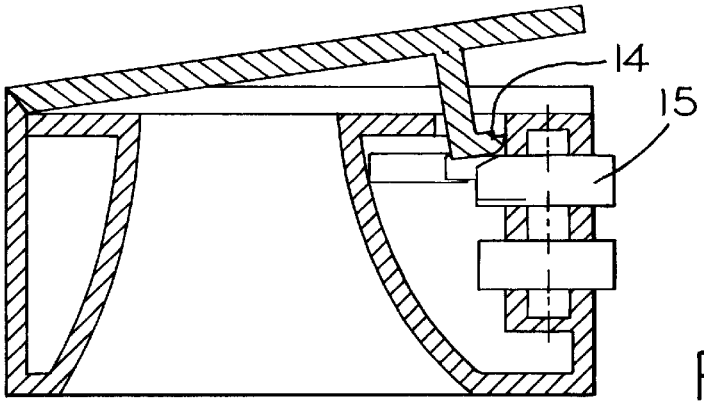
FIG. 4 shows the embodiment of FIGS. 2A through 3B, with the lid opened.

When the lid is depressed in the direction of the arrow 20 shown in FIG. 3A, the lug 14 and recess 19 are disengaged, and the cylindrical member can be moved into the unlocked position shown in FIG. 3B. The lid can now be opened, as shown in FIG. 4. When no longer operated, the cylindrical member will automatically return to the locked position shown in FIG. 2A. However, the lid can still be closed, since the lug 14 is flexible and can pass over the chamfer on the top surface of the cylindrical member. Once the lid is pressed home, it will automatically be in the closed position.

Figure 5:
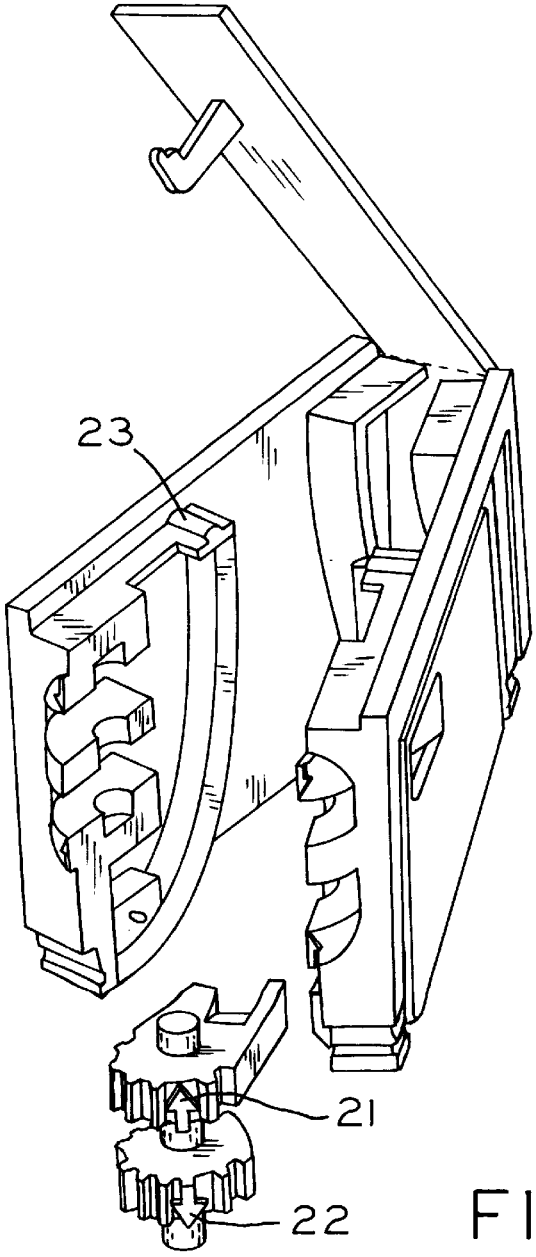
FIG. 5 is a perspective view that shows the construction of the embodiment of FIGS. 2A through 4, illustrating how the body is formed as a one-piece construction.
Figure 6:
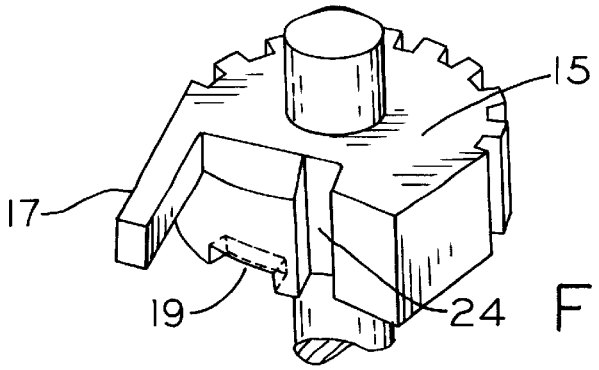
FIG. 6 is a perspective view of part of FIG. 5, shown, in greater detail.
Figure 7A:
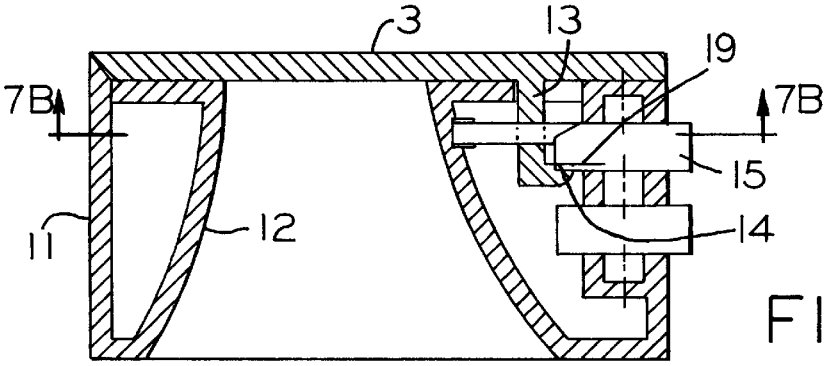
Figure 7B:
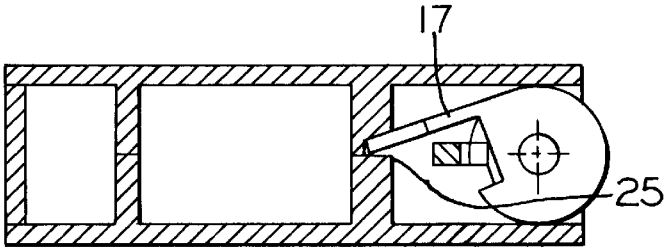
Figure 8A:
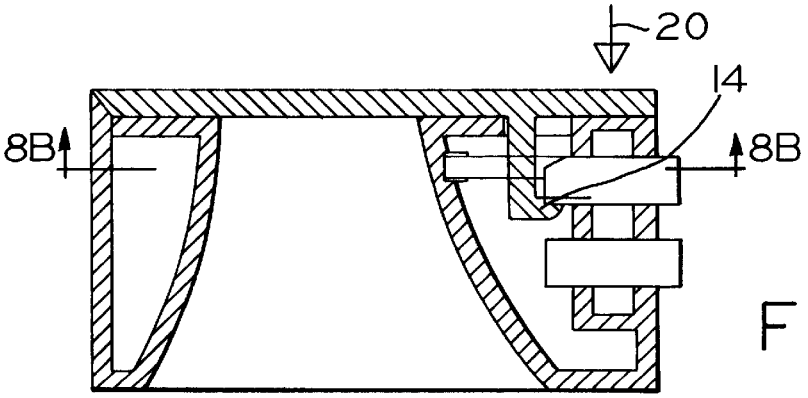
Figure 8B:
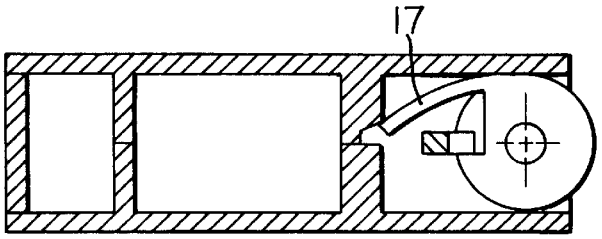
Figures 9A, 9B, 9C, 9D:
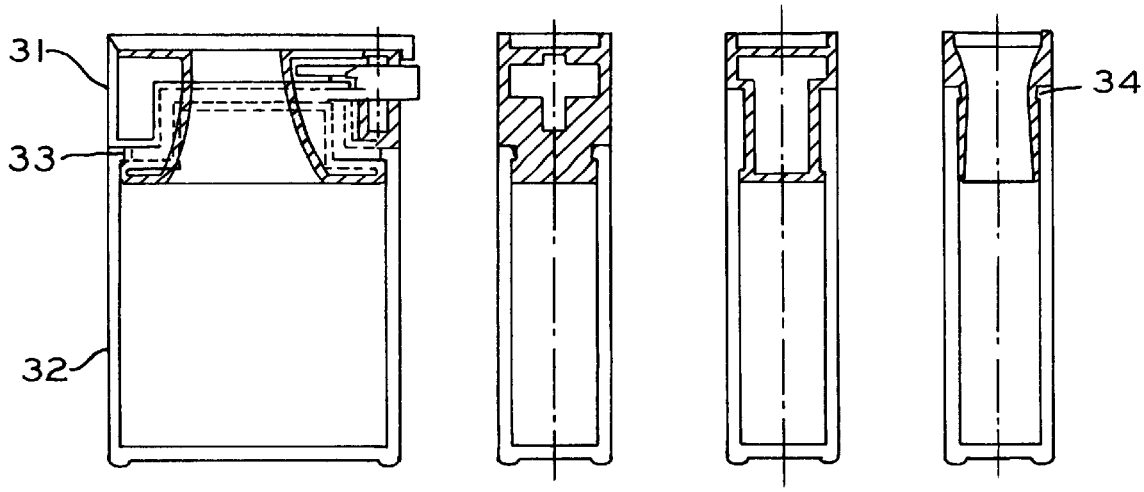
FIGS. 9A through 9D are associated sectional views of a further container of the invention.

Further details of these various components are shown in FIGS. 5 and 6. FIG. 5 shows optional alignment indicators 21 and 22, and a seal 23. This seal serves to prevent air ingress, and provides a resilient surface against which the lid can be depressed, allowing release. The sides of the upper section of the container are locked together by one or more interference joints. FIG. 6 shows in particular a slot 24, through which the lug 14 can pass in the open position.

The biasing system means that the cylinder 15 can only be turned in one direction. As the cylinder 15 is turned towards the open position, the lug 17 on the cylinder 15 presses against what is effectively a plastic spring 16 (FIGS. 2B and 3B), causing tension. Once the lid lug 14 has risen up the vertical slot 24, the cylinder 15 will automatically move back from the open position into a locked position as it is under tension.

FIGS. 7A and 7B and FIGS. 8A and 8B correspond to FIGS. 2A and 2B and FIGS. 3A and 3B respectively. Instead of the biasing element 16, a recess 25 is provided.

Figure 10A:
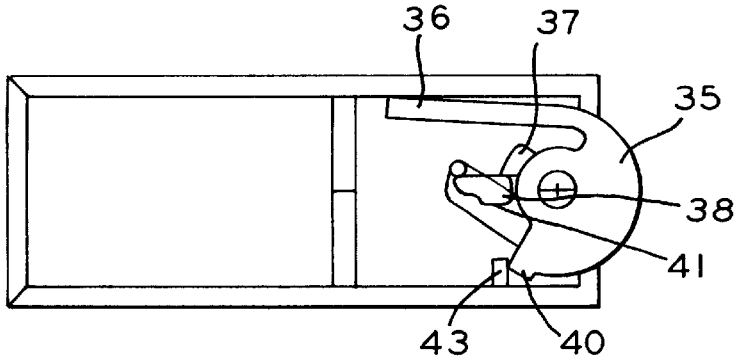
FIGS. 10A and 10B are of associated orthogonal cut-away views of the top part of the container of FIGS. 9A through 9D, in the locked and unlocked positions.
Figure 10B:
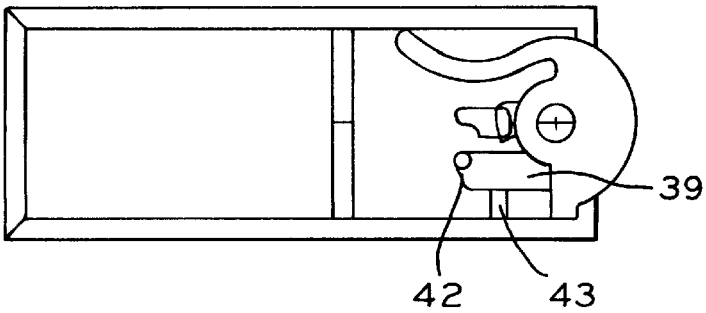

FIGS. 9A through 9D show a further embodiment of the container, comprising a top part 31 and a lower part 32 which have a latch fit at 33 and 34, providing an air and moisture seal (any similar joint, e.g. a knife-edge joint, or a bead and groove, would also be satisfactory). A particular embodiment of the cylinder 4 for use in such a container is shown in FIGS. 10A and 10B, where a generally cylindrical member 35 is formed with a sprung arm 36, a retaining part 37 for the lid lug 38, another arm 39 and a stop member 40. The lid lug 38 is formed with a recess 41 that cooperates with an pin 42 of the arm 39. There is also a detent 43 on the body.

The arm 36 is sprung so that, in the unbiased state, it has the configuration shown in FIG. 10B. In this (locked) position, the part 37 retains the lug 38. After depression of the lid, and then after rotation of the member 35 to the position shown in FIG. 10A, against the bias, but not beyond the interaction of stop member 40 and detent 43, the lug is released. In addition, the pin 42 on the arm 39 is adapted to ease past the recess 41, providing a lock in the open position. This is released on opening the lid.

Figure 11A:
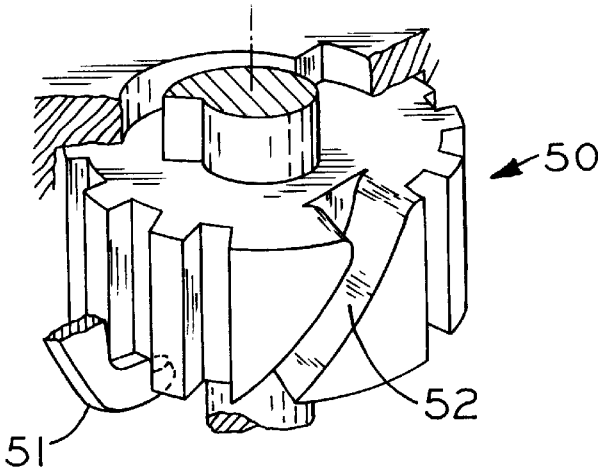
FIGS. 11A through 11D and 12 are perspective views of parts of alternative embodiments of the invention.
Figure 11B:
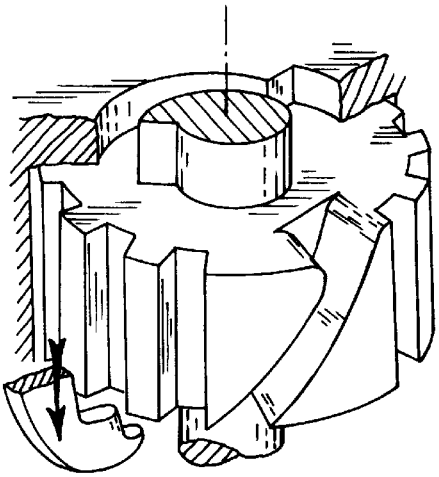
Figure 11C:
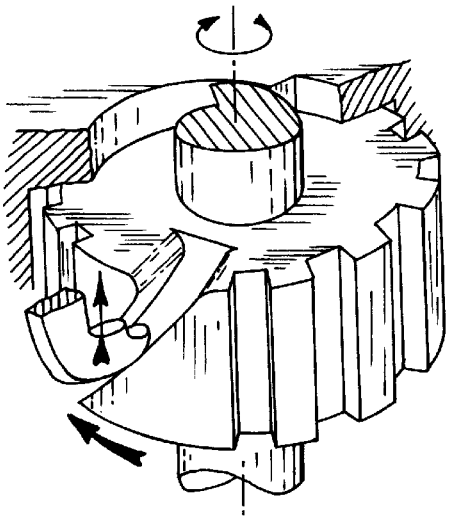
Figure 11D:
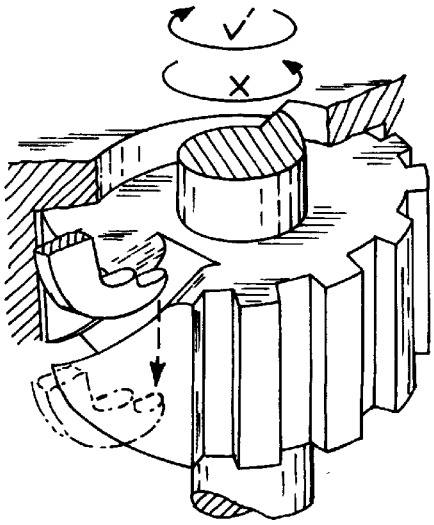

FIGS. 11A through 11B show an alternative cylindrical member 50, in various stages of rotation relative to a lug 51. The cylindrical member includes a slanted groove 52. As the lid is raised, the lug forces the cylindrical member to turn, and this means; that when the lug is fully retracted, the groove 52 is no longer in an open position. If the lid was then closed, the lug would simply follow the route it took to open and the cylindrical member would rotate back into its original position.

To stop the cylindrical member from returning to its original position, a ratchet mechanism may be incorporated on the upper cylindrical member bearing. Such a mechanism may also be incorporated on any or all of the bearings. This means that the cylindrical member can only fully turn in one direction. With the ratchet device, the lug cannot force the cylindrical member back in the direction it has come, and this in combination with the slanted groove 42 means that the lock is self-locking.

As described with reference to FIGS. 10A and 10B, a, preferred feature of the invention is that there should be parts on the lid and/or the cylindrical member, that cooperate to hold the cylindrical member, at least temporarily, in the open position. This enables the user to "locate" this position readily, by touch. Further embodiments of this feature will now be described.

Figure 12:
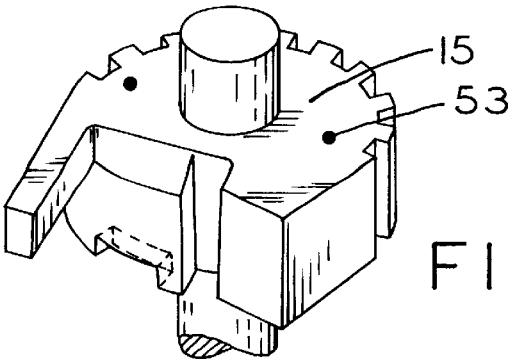

FIG. 12 shows a cylindrical member 15 as in FIG. 6, with the additional feature of nodules/dimples 53. They cooperate with corresponding dimples/nodules (not shown) on the lid, in the open position. When the lid is raised, the cooperation is lost and the cylindrical member returns automatically to the locked position. As alternatives to the nodules/dimples, cooperating pairs of detents, or a bar and detents, that slide past each other may be used.

Figure 13A:
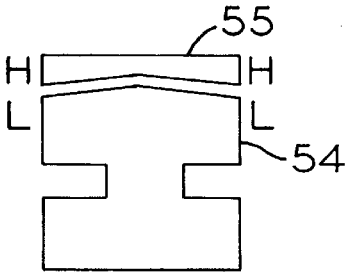
FIGS. 13A through 13D are schematic views of a part of a yet further embodiment of the invention.
Figure 13B:
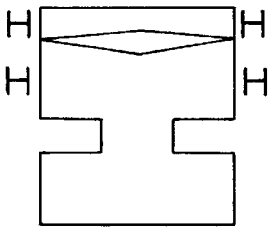
Figure 13C:
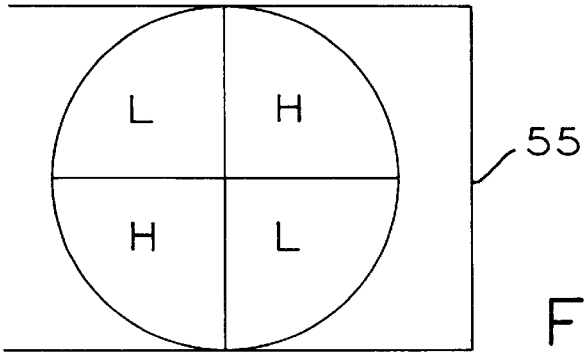
Figure 13D:
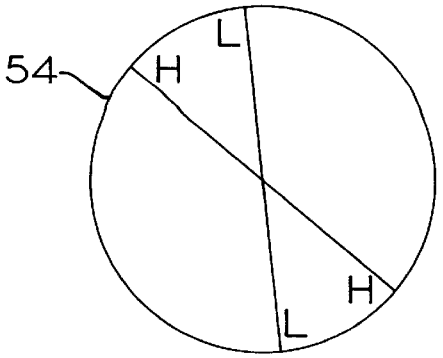

FIGS. 13A through 13D shows an alternative means of achieving the same end. A cylindrical member 54 and a lid 55 (each shown in part) are shaped so that they are complementary in the closed position (FIG. 13A) and opposed in the open position (FIG. 13B). These shapes are provided by the opposed quadrants, relatively high (H) and low (L) on the lower face of the lid (see FIG. 13C) and raised sections on the top of the cylindrical member (see FIG. 13D).

Figure 14A:
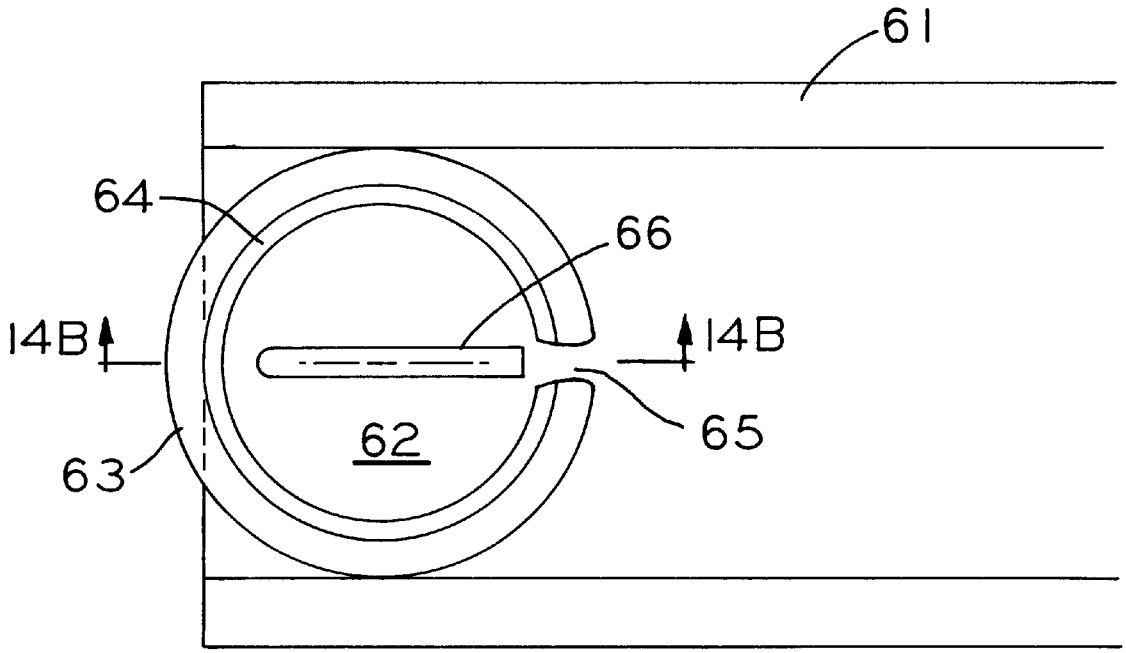
FIGS. 14A and 14B are associated orthogonal schematic views (partially cut-away) of yet another embodiment of the invention.
Figure 14B:
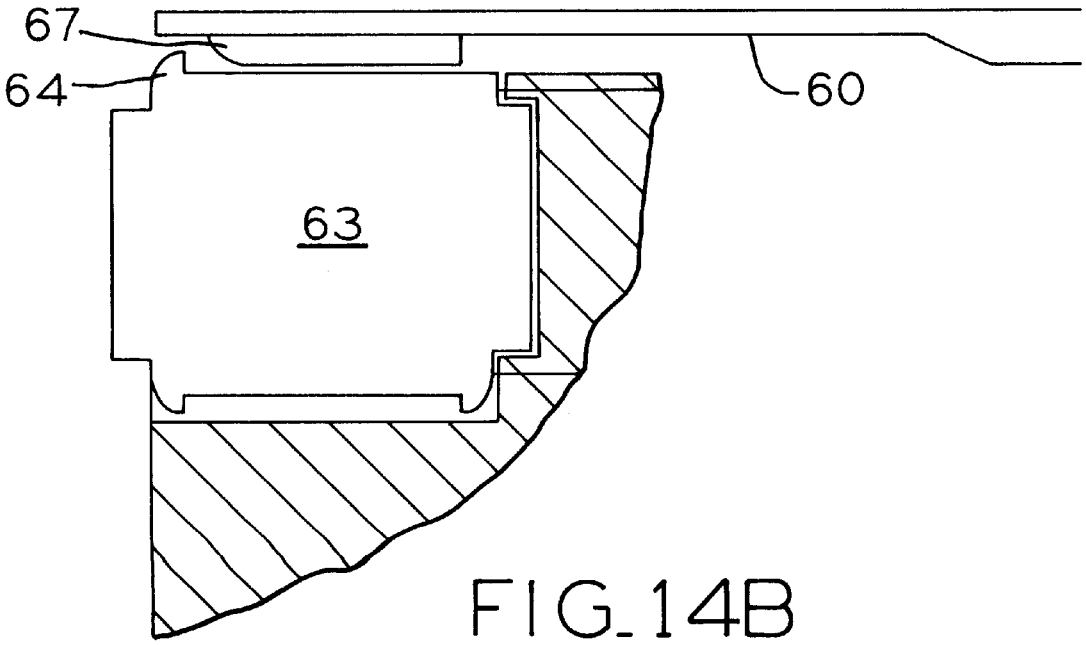

The embodiments described above utilise a hinged lid. An alternative is a sliding lid. FIG. 14 shows a sliding lid 60 that runs in rebated grooves within the edges 61 of the container. The top 62 of the cylindrical member 63 comprises an essentially circular flange 64 including a discontinuity 65 which corresponds to a bar 66 on the underside of the lid 60. FIG. 14A shows the container in the open position; at a different angular position of the cylindrical member, into which it is biassed by a spring (not shown), the flange prevents the lid from being slid open. However, the chamfered edge 67 of the bar 66 allows the lid to be closed in that position.

It will be readily apparent to the skilled reader that variations can be made in the embodiments described above, without departing from the invention. Thus, merely by way of example, individual components may be constructed from more than one part.

What is claimed is:

1. A container requiring more than one operation to open, said container comprising:

a hollow body;

a lid attached to the hollow body and which opens in a given direction;

a manually-operable member that is biased by a biasing element into a first position at which the member engages the closed lid, and moveable against the biasing element into a second position at which the lid is releasable;

in the first position, the lid positively engages the member and is disengageable from the member by first moving the lid in a direction other than the given direction in which the lid opens;

the lid being closeable when the member is in the first position.

2. A container according to claim 1, in which the hollow body includes an aperture within which the member is moveable.

3. A container according to claim 2, in which the member is a rotatable cylinder.

4. A container according to claim 2, in which the member includes a face opposite to the lid, and the lid is hingedly attached to the hollow body and includes a tongue, reaching into the hollow body, with a lug that is engaged by the face of the member in the first position, the member being cut away so that the tongue can pass in the second position.

5. A container according to claim 2, in which the biasing element comprises a flexible protrusion formed as part of one of the body and the member.

6. A container according to claim 1, in which the member is a rotatable cylinder.

7. A container according to claim 6, wherein the hollow body includes a top portion, and the lid lies across the top portion, and the cylinder rotates in a plane parallel to the lid.

8. A container according to claim 7, in which the member includes a face opposite to the lid, and the lid is hingedly attached to the hollow body and includes a tongue, reaching into the hollow body, with a lug that is engaged by the face of the member in the first position, the member being cut away so that the tongue can pass in the second position.

9. A container according to claim 7, in which the biasing element comprises a flexible protrusion formed as part of one of the body and the member.

10. A container according to claim 6, in which the member includes a face opposite to the lid, and the lid is hingedly attached to the hollow body and includes a tongue, reaching into the hollow body, with a lug that is engaged by the face of the member in the first position, the member being cut away so that the tongue can pass in the second position.

11. A container according to claim 2, in which the member is a rotatable cylinder.

12. A container according to claim 1, in which the member includes a face opposite to the lid, and the lid is hingedly attached to the hollow body and includes a tongue, reaching into the hollow body, with a lug that is engaged by the face of the member in the first position, the member being cut away so that the tongue can pass in the second position.

13. A container according to claim 12, in which the lug positively engages with a corresponding recess in the member in the first position, and depression of the lid is required to ensure disengagement.

14. A container according to claim 12, in which the biasing element comprises a flexible protrusion formed as part of one of the body and the member.

15. A container according to claim 13, in which the biasing element comprises a flexible protrusion formed as part of one of the body and the member.

16. A container according to claim 1, in which the biasing element comprises a flexible protrusion formed as part of one of the body and the member.

17. A container according to claim 1, wherein the member includes upper and lower faces orthogonal to the direction in which the lid opens, the upper face shaped to allow the lid to ride over the upper face on closing the lid.

18. A container according to claim 1, which comprises parts on at least one of the lid and the member, that cooperate to hold the member in the second position.

* * * * *